United States Patent [19]

Terashima et al.

[11] 4,270,487

[45] Jun. 2, 1981

[54] DEVELOPER REGULATING DEVICE IN DEVELOPING APPARATUS

[75] Inventors: Isamu Terashima; Toshio Twubaki; Masayasu Anzai, all of Hitachi, Japan

[73] Assignee: Hitachi, Ltd., Tokyo, Japan

[21] Appl. No.: 952,735

[22] Filed: Oct. 19, 1978

[30] Foreign Application Priority Data

Oct. 27, 1977 [JP] Japan ..... 52/128990
Jun. 7, 1978 [JP] Japan ..... 53/67659

[51] Int. Cl.[3] ..... G03G 15/06

[52] U.S. Cl. ..... 118/690; 118/694; 118/712; 324/236; 355/3 DD

[58] Field of Search ..... 355/3 R, 3 DD; 324/204, 324/236, 452, 455, 457, 458; 118/646, 688, 689, 693, 690, 694, 712

[56] References Cited

U.S. PATENT DOCUMENTS

| | | | |
|---|---|---|---|
| 3,593,842 | 7/1971 | Berg | 118/646 X |
| 3,834,806 | 9/1974 | Whited | 355/3 DD |
| 3,892,672 | 7/1975 | Gawron | 355/3 DD X |
| 3,999,687 | 12/1976 | Baer et al. | 118/646 X |
| 4,088,092 | 5/1978 | Noguchi | 118/646 X |
| 4,147,127 | 4/1979 | Terashima | 118/646 |
| 4,168,901 | 9/1979 | Ito et al. | 355/3 DD |

*Primary Examiner*—Fred L. Braun
*Attorney, Agent, or Firm*—Craig & Antonelli

[57] ABSTRACT

A developer level sensor installed on the sidewall of a developer container in a developing apparatus consists of an oscillator circuit with multiple coils, the mutual inductance of which is adjusted by a moveable electric conductor. The lower limit level of developer sensed may be adjusted by the positioning of a control plate.

8 Claims, 7 Drawing Figures

DEVELOPER REGULATING DEVICE IN DEVELOPING APPARATUS

BACKGROUND OF THE INVENTION

1. Field of the Invention

This invention relates to a developer regulating device in developing apparatus. More particularly, it relates to developing apparatus which can detect the quantity of a developer in a developer container and give notice of the replenishment of the developer.

2. Description of the Prior Art

An electrostatic latent image in electrostatic recording equipment is developed by developing apparatus. As the developing apparatus, dry type ones employing powder developers have been adopted in recent years. The powder developers include a one-component developer in which a toner itself assumes magnetism, and a two-component developer in which a toner and a magnetic carrier are mixed. By developing the electrostatic latent image, the developer in the developing apparatus is consumed. It is accordingly necessary that the remaining quantity of the developer be detected so as to replenish the developer. Most of the consumption in the two-component developer is the toner. In the developing apparatus employing the two-component developer, therefore, it suffices to replenish only the toner in many cases.

As a developer regulating device in the developing apparatus employing the two-component developer, there has heretofore been proposed a detection system in which a change in the magnetic permeability of the developer is detected. An example thereof is U.S. Pat. No. 3,572,551 (Inventors: Gillespie et al, application Ser. No.: 811,132, Filed: Mar. 27, 1969, Patented: Mar. 30, 1971, Assignee: RCA Corporation). Such a regulating device, however, has the disadvantage of requiring a mechanism for sampling the developer and becoming complicated.

SUMMARY OF THE INVENTION

Objects

An object of this invention is to provide a developer regulating device of simple construction.

An object in one concrete embodiment of this invention is to provide a developer regulating device which can control the mixing ratio of a two-component developer between a toner and a magnetic carrier within a predetermined range.

An object in another concrete embodiment of this invention is to provide a developer regulating device which is effective to keep the quantity of a magnetic developer at a predetermined quantity or above the minimum necessary quantity.

Summary

This invention consists in that the quantity of a developer in a developer container is detected by the presence or absence of oscillation owing to a responsive element or sensor which is installed on the developer container.

According to this invention, the responsive element has an electric coil, which constitutes part of an oscillation circuit. In the case where the quantity of the developer in the developer container is large, the magnetism of the developer acts intensely on the electric coil, and the oscillating condition of the oscillation circuit is established. When the level of the developer lowers due to the consumption thereof and the magnetism acting on the electric coil decreases, the oscillating condition of the oscillation circuit fails to hold and the oscillation stops.

DETAILED DESCRIPTION OF THE PREFERRED EMBODIMENTS

Figure 1:
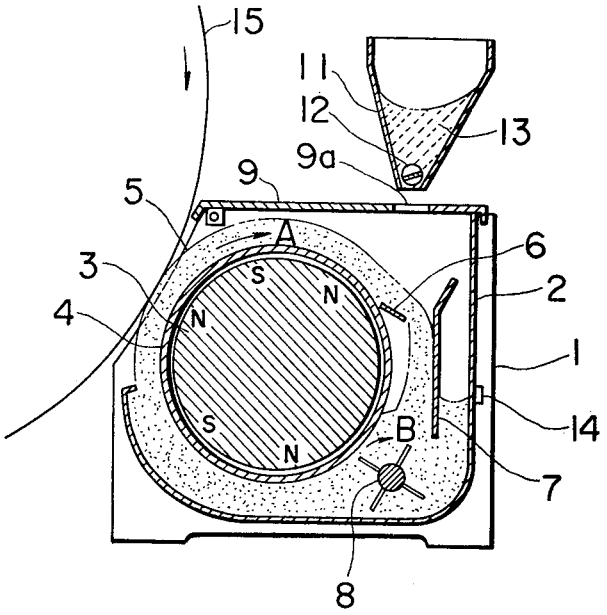
FIG. 1 is a vertical sectional side elevation of developing apparatus employing a two-component developer.
Figure 2:
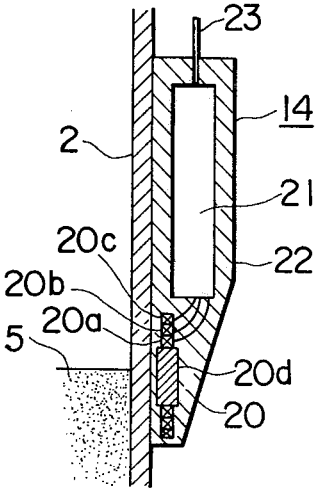
FIG. 2 is a vertical sectional side elevation which shows the mounted state of a sensor on a developer container.

Referring to FIG. 1, numeral 1 designates two side plates, and numeral 2 a bottom plate arranged between the side plates 1. These plates form a developer container. In relation to a developer sensor to be described later, the bottom plate 2 is desirably made of a nonmagnetic substance such as aluminum and synthetic resin. Numeral 3 indicates a fixed roll-shaped magnet which is arranged between the side plates 1, while numeral 4 indicates a nonmagnetic sleeve which is rotatably supported around the magnet 3. As has already been known, the sleeve 4 is driven in the direction of arrow A by a power mechanism (not shown), and it rotates while attracting and holding a two-component developer 5 on its surface (forming a magnetic brush of the developer) owing to the magnetic force of the magnet 3. The magnetic brush performs development by lightly rubbing the surface of a photosensitive member 15 which is formed with an electrostatic latent image. Shown at 6 is a separator plate, which scrapes off the developer deposited on the surface of the sleeve 4 after the developing step. A stabilizer plate 7 serves to stabilize the level of the developer in the developer container. A stirrer 8 agitates the developer while rotating in the direction of arrow B, to make the mixed state of a magnetic carrier and a toner uniform. A cover 9 of the developer container has a toner replenishing port 9*a*. Numeral 11 denotes a hopper for replenishment toner, numeral 12 a supplementary feed valve which is controlled by a solenoid, and numeral 13 the toner to be replenished. Shown at 14 is a developer level detector, which will now be described with reference to FIGS. 2 to 4. As illustrated in FIG. 2, the detector 14 is constructed of a coil unit 20, a circuit unit 21, and a molding resin 22 which integrally molds the units into a structure to be mounted on the bottom plate 2. The coil unit 20 includes three electric coils 20*a*–20*c* concentrically disposed, and a core 20*d*. Since, however, the core 20*d* is for miniaturizing the coil assembly, it may sometimes be omitted. The circuit unit 21 includes a feedback oscillator circuit, a rectifier circuit and an output circuit. As seen from FIG. 4, the feedback oscillator circuit is constructed of capacitors $C_1$, $C_2$ and $C_3$, resistors $R_1$, $R_2$ and $R_3$, a transistor $Q_1$, and electric coils 20*a* and 20*b*.

The rectifier circuit is constructed of a diode $D_1$ and a capacitor $C_4$, and it rectifies and smooths a voltage induced in the electric coil 20c. The output circuit is constructed of resistors $R_4$, $R_5$ and $R_6$ and transistors $Q_2$ and $Q_3$, and it amplifies and delivers a terminal voltage of the capacitor $C_4$. Numeral 23 indicates a group of terminals, which includes power source terminals 23a and 23c and an output terminal 23b. The power source terminals 23a and 23c are connected to a d.c. power supply 31, while the output terminal 23b is connected to the solenoid 30 for driving the supplementary feed valve 12. The detector 14 thus constructed is mounted on the bottom plate 2 so that the oscillating condition of the feedback oscillator circuit may hold within a range of or above a predetermined developer level within which the magnetism of the developer 5 influences the coil unit 20 intensely. In some cases, it is possible to provide a window in a part of the bottom plate 2 opposite the coil unit 20 so that the developer 5 may act directly on the detector 14.

In such developing apparatus in electrophotographic equipment, the sleeve 4 rotates in the direction of arrow A, forms the magnetic brush of the developer 5 on its surface and develops the electrostatic latent image on the photosensitive member. After passing through a developing zone, the developer 5 is separated from the surface of the sleeve 4 and scraped off into the container by the separator plate 6. The scraped-off developer 5 is agitated by the stirrer 8, and is recirculated so as to form the magnetic brush again. The stabilizer plate 7 stabilizes the level of the developer 5 in the container so that the stabilized level may act on the detector 14. Since the magnetic carrier in the developer is scarcely consumed, the level of the developer 5 varies in proportion to the quantity of the toner (the mixing ratio between the toner and the magnetic carrier). When the quantity of the toner is large (the mixing ratio of the toner is great), the level of the developer 5 in the container is high, and the magnetic influence on the detector 14 is great. Accordingly, the mutual inductance between the electric coils 20a and 20b is high, and the feedback oscillator circuit has the oscillating condition established and oscillates. In this state in which the oscillating condition holds and the feedback oscillator circuit oscillates, the voltage is induced in the electric coil 20c. This voltage is rectified by the diode $D_1$ and charges the capacitor $C_4$. Consequently, the transistor $Q_2$ turns "on" and the transistor $Q_3$ turns "off", so that no current flows through the solenoid 30.

However, when the toner is consumed, the total amount of the developer 5 decreases. Therefore, the developer level becomes lower than the mounted position of the detector 14, and the magnetic influence on the detector 14 decreases. Accordingly, the mutual inductance between the electric coils 20a and 20b lowers, the oscillating condition of the feedback oscillator circuit fails to hold, and the oscillation stops. Thus, the induced voltage of the electric coil 20c vanishes. Consequently, the terminal voltage of the capacitor $C_4$ lowers, the transistor $Q_2$ turns "off" and the transistor $Q_3$ turns "on", current flows through the solenoid 30, and the supplementary feed valve 12 is opened to replenish the toner 13.

The developing apparatus above described regulates the mixing ratio of the toner in a manner to keep the quantity of the developer 5 at a predetermined value. Usually, the change of the mutual inductance between the electric coils 20a and 20b ascribable to the increase or decrease of the developer 5 is sufficiently large in the upper level region of the developer 5. In practical use, therefore, the dispersion of the characteristics of the constituent components including the electric coils poses almost no problem. This signifies easy design and fabrication.

Figure 3:
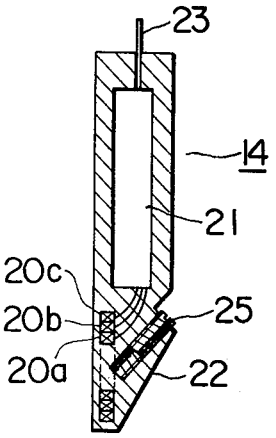
FIG. 3 is a vertical sectional side elevation which shows another embodiment of the sensor.
Figure 4:
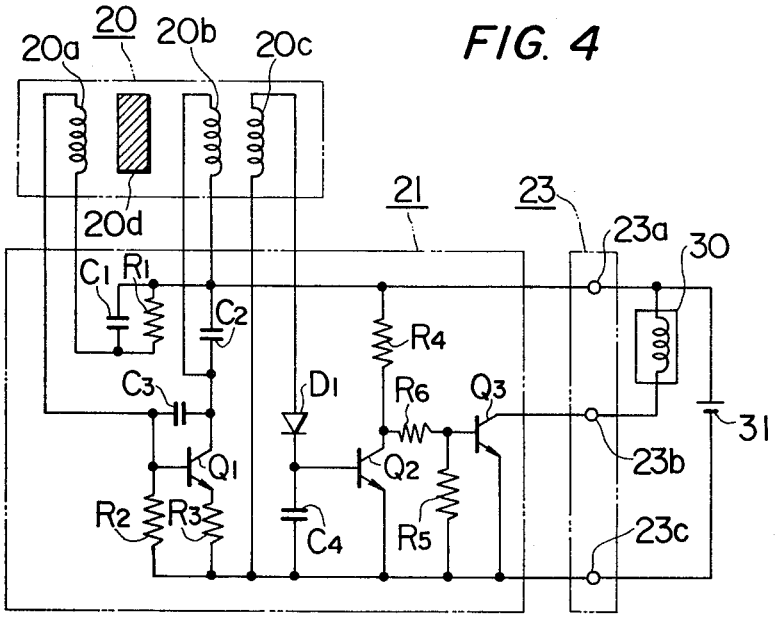
FIG. 4 is an electrical circuit diagram.

However, in the case where a control of especially high precision is expected or where it is desired to change a set mixing ratio, the oscillating condition can be regulated with an adjusting screw 25 as illustrated in FIG. 3. Herein, in the case where the adjusting screw 25 is made of a ferromagnetic substance of low loss such as ferrite, the mutual inductance between the electric coils 20a and 20b may be made low in advance so that it may become high when the adjusting screw 25 is threadably inserted.

In the case where the adjusting screw 25 is made of an electric conductor which exhibits a heavy loss due to electromagnetic induction (ordinary metallic material), the mutual inductance between the electric coils 20a and 20b may be made high in advance so that it may become low when the adjusting screw 25 is threadably inserted.

In order to make a leakage magnetic field by the magnet 3 less influential, the adjusting screw 25 may be made of a nonmagnetic conductor.

Figure 5:
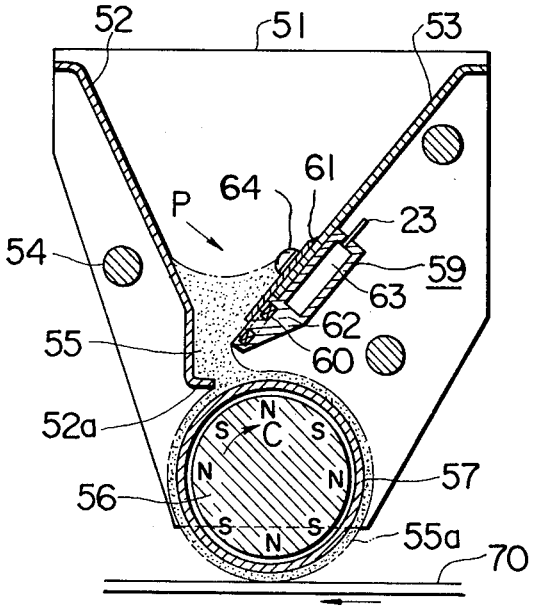
FIG. 5 is a vertical sectional side elevation of developing apparatus employing a one-component developer.
Figure 6:
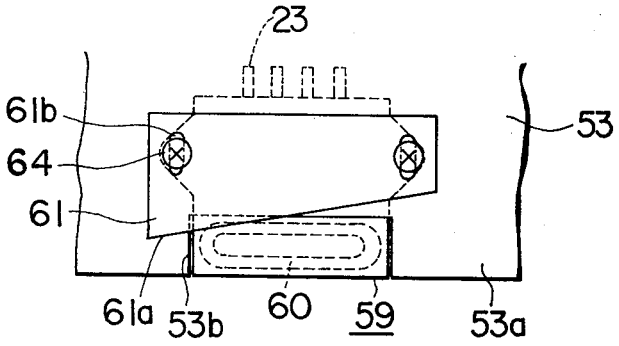
FIG. 6 is a sketch viewed in the direction of arrow P in FIG. 5.

FIGS. 5 and 6 illustrate developing apparatus employing a one-component developer. In these figures, numeral 51 designates side plates opposing each other, and numerals 52 and 53 designate first and second panels respectively. These parts form a developer container which has a discharge port at its bottom. Shown at 54 is a spacer for properly assembling the side plates 51 and the panels 52 and 53. Numeral 55 indicates a magnetic developer of one component (magnetic toner). The quantity of the developer 55 which is discharged from the discharge port of the developer container is controlled by a control surface 53a at the lower end of the second panel 53. Numeral 56 indicates a roll-shaped magnet, which is supported by the side plates 51 in a manner to be rotatable in the direction of arrow C. Numeral 57 indicates a nonmagnetic sleeve, which is supported around the roll-shaped magnet 56 so as to rotate in the direction opposite to that of the arrow C. Either of the roll-shaped magnet 56 and the sleeve 57 may be kept stationary. Shown at 55a is a magnetic brush, which is formed in such a manner that the magnetic developer 55 is attracted by the magnetic force of the magnet 56 to adhere on the periphery of the sleeve 57. The height of the spearhead of the magnetic brush 55a is controlled by a control end surface 52a, and the fore end of the brush lightly rubs the surface of a photosensitive member 70 retaining an electrostatic latent image. Numeral 59 designates a developer level detector. It consists of a coil unit 60, a circuit unit 63, a molding resin 62, etc. similar to the developer level detector shown in FIGS. 2 to 4. The coil unit 60 includes three coils which are flat and elliptical and which are concentrically wound, so as to respond to the mean level of the developer 55 in the container. The detector 59 is mounted together with a control plate 61 at a lower edge part of the second panel 53 by screws 64. As regards the control plate 61, one side 61a close to the coils is slanted relative to the coil unit 60, and the mounted position can be adjusted owing to slots 61b. The control plate 61 is made of a conductive material such as metal. In order to prevent it from undergoing the magnetic induction of the roll-shaped magnet 56, a nonmagnetic material such as aluminum and copper may be used. By adjusting the mounted position of the control plate 61 as described above, the influence of the magnetism of the developer 55 on the coil unit 60 changes. At this time, the inclination of the side 61*a* serves to moderate the change of the magnetic influence. In the case where the second panel 53 is made of a conductor such as aluminum, a closed conductor loop is formed of the panel 53 in the vicinity of the coil unit 60, and the magnetic influence of the developer 55 on the coil unit 60 lowers. In such a case, accordingly, it is advisable to provide a cut-away portion 53*b* in a lower end part of the second panel 53 and arrange the portion of the coil unit 60 therein lest the closed loop should be formed. When it is made possible to adjust the mounted position of the detector 59, the control plate 61 and the adjusting screw 25 can be dispensed with.

Figure 7:
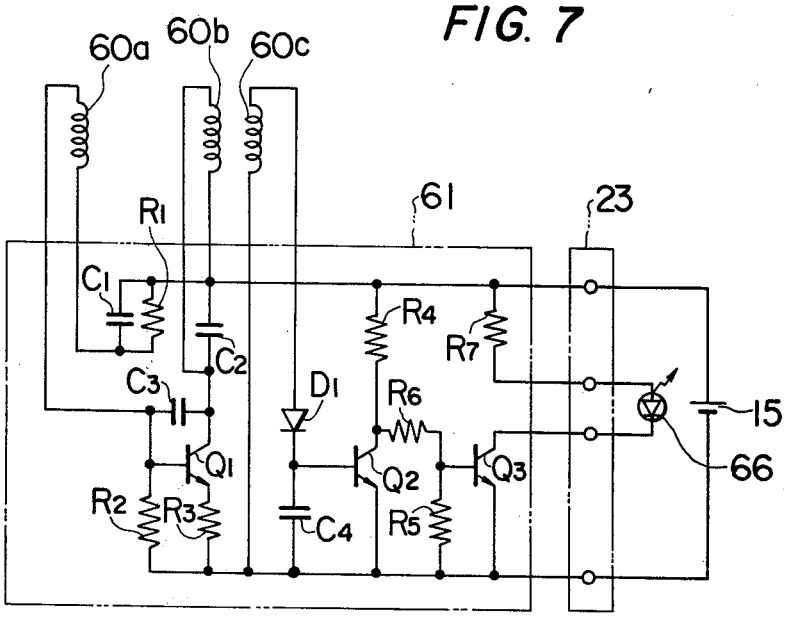
FIG. 7 is an electrical circuit diagram.

An electric circuit of the detector 59 is shown in FIG. 7. Since this electric circuit is arranged similarly to that shown in FIG. 4, the detailed explanation is omitted. The collector of the transistor $Q_3$ is connected to the power supply through an indicating lamp (light emitting diode) 66 as well as a resistor $R_7$. Electric coils 60*a*–60*c* correspond to the coil unit 60. The others are the same as in FIG. 4.

In the above construction, in the case where the developer 55 exists near the coil unit 60 as illustrated in FIG. 5, the mutual inductance between the coils 60*a* and 6*b* is high because the developer 55 is a magnetic material, and the feedback oscillator circuit falls into the oscillating state. The oscillation output is derived by the coil 60*c*, whereupon it is rectified by the diode $D_1$ and stored in the capacitor $C_4$. When the terminal voltage of the capacitor $C_4$ is great, the transistor $Q_2$ turns "on" and the transistor $Q_3$ turns "off", so that the indicating lamp 66 is not lit up. However, when the quantity of the developer 55 decreases and the developer becomes non-existent near the coil unit, the mutual inductance between the coils 60*a* and 60*b* lowers, and the oscillator circuit stops the oscillation. Thus, the voltage induced in the coil 60*c* vanishes. Therefore, the terminal voltage of the capacitor $C_4$ lowers, and the transistor $Q_2$ turns "off" and the transistor $Q_3$ "on". The indicating lamp 66 is consequently lit up to indicate that the quantity of the developer 55 has become smaller than the lower limit value. When a developer supplementing valve is used instead of the indicating lamp 66, the developer can be automatically replenished.

The lower limit value of the quantity of the developer 55 can be controlled by the positioning of the control plate 61, the positioning of the detector 59, the positioning of the adjusting screw 25, etc.

Although the two aspects of performance have been described above, it is to be understood that the present invention can be readily modified on the basis of the technical ideas incorporated in these aspects of performance.

We claim:

1. In developing apparatus having a developer container which receives a magnetic developer, conveyance means for conveying the developer from the developer container and bringing it into contact with a surface to-be-developed to develop an electrostatic latent image, and a developer sensor which is disposed at a predetermined position of the developer container, a quantity of the developer within the developer container being detected in accordance with an output of the developer sensor, developing apparatus characterized by comprising:

an electric coil which is included in said developer sensor, an oscillator circuit which includes said electric coil as one circuit element thereof, means for mounting said developer sensor on said developer container so that an oscillating condition of said oscillator circuit may hold by sensing the developer of at least a predetermined level in said developer container and that the oscillating condition may fail to hold by sensing the developer below said predetermined level, and means for detecting the quantity of said developer within said developer container in dependence on the presence or absence of an oscillation output of said oscillator circuit, wherein said developer sensor has a moveable electric conductor at a position at which it is electromagnetically coupled with a coil conductor.

2. In developing apparatus having a developer container which receives a magnetic developer, conveyance means for conveying the developer from the developer container and bringing it into contact with a surface to-be-developed to develop an electrostatic latent image, and a developer sensor which is disposed at a predetermined position of the developer container, a quantity of the developer within the developer container being detected in accordance with an output of the developer sensor, developing apparatus characterized by comprising:

an electric coil which is included in said developer sensor, an oscillator circuit which includes said electric coil as one circuit element thereof, means for mounting said developer sensor on said developer container so that an oscillating condition of said oscillator circuit may hold by sensing the developer of at least a predetermined level in said developer container and that the oscillating condition may fail to hold by sensing the developer below said predetermined level, and means for detecting the quantity of said developer within said developer container in dependence on the presence or absence of an oscillation output of said oscillator circuit, wherein said developer sensor has a moveable magnetic material at a position at which it is electromagnetically coupled with a coil conductor.

3. In developing apparatus having a developer container which receives a magnetic developer, conveyance means for conveying the developer from the developer container and bringing it into contact with a surface to-be-developed to develop an electrostatic latent image, and a developer sensor which is disposed at a predetermined position of the developer container, a quantity of the developer within the developer container being detected in accordance with an output of the developer sensor, developing apparatus characterized by comprising:

an electric coil which is included in said developer sensor, an oscillator circuit which includes said electric coil as one circuit element thereof, means for mounting said developer sensor on said developer container so that an oscillating condition of said oscillator circuit may hold by sensing the developer of at least a predetermined level in said developer container and that the oscillating condition may fail to hold by sensing the developer below said predetermined level, and means for detecting the quantity of said developer within said developer container in dependence on the presence or absence of an oscillation output of said oscillator circuit, wherein said developer sensor has a moveable nonmagnetic electric conductor at a position at which it is electromagnetically coupled with a coil conductor.

4. In developing apparatus having a developer container which receives a magnetic toner, conveyance means for conveying the toner from the developer container and bringing it into contact with a surface to-be-developed to develop an electrostatic latent image, and a magnetic sensor which is disposed at a predetermined position of the developer container, a quantity of the toner within the developer container being detected in accordance with an output of the magnetic sensor, developing apparatus characterized by comprising:

an electric coil which is included in said magnetic sensor, an oscillator circuit which includes said electrical coil as one circuit element thereof, means for mounting said magnetic sensor on said developer container so that an oscillating condition of said oscillator circuit may hold by sensing the toner in at least a predetermined lower limit quantity within said developer container and that the oscillating condition may fail to hold by sensing the toner in a quantity smaller than said predetermined lower limit quantity, and means for detecting the quantity of said toner within said developer container in dependence on the presence or absence of an oscillation output of said oscillator circuit, wherein said developer container has a nonmagnetic metal plate which is provided with a cut-away portion at a lower end part thereof, said magnetic sensor being arranged in said cut-away portion.

5. In developing apparatus having a developer container which receives a magnetic developer, conveyance means for conveying the developer from the developer container and bringing it into contact with a surface to-be-developed to develop an electrostatic latent image, and a developer sensor which is disposed at a predetermined position of the developer container, a quantity of the developer within the developer container being detected in accordance with an output of the developer sensor, developing apparatus comprising:

at least two electric coils which are included in said developer sensor and disposed such that a mutual inductance of said two electric coils varies in response to magnetic influence of the developer on said coils, a feedback oscillator circuit including an amplifying circuit having an input circuit connected to one of said coils and having an output circuit connected to the other of said coils, means for mounting said developer sensor on said developer container so that an oscillating condition of said oscillator circuit may hold under the magnetic influence of the developer of at least a predetermined level in said developer container and that the oscillating condition may fail to hold under the magnetic influence of the developer below said predetermined level, and means for detecting the quantity of said developer within said developer container in dependence on the presence or absence of an oscillation output of said oscillator circuit.

6. Developing apparatus according to claim 5, characterized in that said amplifying circuit includes a transistor having a base electrode connected to one of said coils and a collector electrode connected to the other of said coils.

7. In developing apparatus having a developer container which receives a magnetic toner, conveyance means for conveying the toner from the developer container and bringing it into contact with a surface to-be-developed to develop an electrostatic latent image, and a magnetic sensor which is disposed at a predetermined position of the developer container, a quantity of the toner within the developer container being detected in accordance with an output of the magnetic sensor, developing apparatus comprising:

at least two electric coils which are included in said magnetic sensor and disposed such that a mutual inductance of said two electric coils varies in response to magnetic influence of the developer on said coils, a feedback oscillator circuit including an amplifying circuit having an input circuit connected to one of said coils and having an output circuit connected to the other of said coils, means for mounting said magnetic sensor on said developer container so that an oscillating condition of said oscillator circuit may hold under the magnetic influence of the toner in at least a predetermined lower limit quantity within said developer container and that the oscillating condition may fail to hold under the magnetic influence of the toner in a quantity smaller than said predetermined lower limit quantity, and means for detecting the quantity of said toner within said developer container in dependence on the presence or absence of an oscillation output of said oscillator circuit.

8. In developing apparatus having a developer container which receives a developer with a magnetic carrier and a toner mixed, conveyance means for conveying the developer from the developer container and bringing it into contact with a surface to-be-developed to develop an electrostatic latent image, and a magnetic sensor which is disposed at a predetermined position of the developer container, a quantity of the developer within the developer container being detected in accordance with an output of the magnetic sensor, developing apparatus comprising:

at least two electric coils which are included in said magnetic sensor and disposed such that a mutual inductance of said two electric coils varies in response to magnetic influence of the developer on said coils, a feedback oscillator circuit including an amplifying circuit having an input circuit connected to one of said coils and having an output circuit connected to the other of said coils, means for mounting said magnetic sensor on said developer container so that an oscillating condition of said oscillator circuit may hold under the magnetic influence of the developer level at a toner concentration of at least a predetermined value within said developer container and that the oscillating condition may fail to hold at a developer level below said predetermined value of the toner concentration, and means for providing an electric output indicative of the lowering of the toner concentration in said developer in dependence on the presence or absence of an oscillation output of said oscillator circuit.

* * * * *